US009839913B2

(12) United States Patent
Lotosky-Compton

(10) Patent No.: US 9,839,913 B2
(45) Date of Patent: Dec. 12, 2017

(54) MEDICAL SPECIMEN CONTAINER

(71) Applicant: Maria Lotosky-Compton, Webster, NY (US)

(72) Inventor: Maria Lotosky-Compton, Webster, NY (US)

( * ) Notice: Subject to any disclaimer, the term of this patent is extended or adjusted under 35 U.S.C. 154(b) by 0 days.

(21) Appl. No.: 14/799,062

(22) Filed: Jul. 14, 2015

(65) Prior Publication Data

US 2016/0008807 A1 Jan. 14, 2016

Related U.S. Application Data

(60) Provisional application No. 62/024,196, filed on Jul. 14, 2014.

(51) Int. Cl.
*B01L 3/00* (2006.01)

(52) U.S. Cl.
CPC ..... *B01L 3/5082* (2013.01); *B01L 2200/025* (2013.01); *B01L 2200/0689* (2013.01); *B01L 2200/141* (2013.01); *B01L 2300/021* (2013.01); *B01L 2300/042* (2013.01); *B01L 2300/044* (2013.01); *B01L 2300/0609* (2013.01); *B01L 2300/0832* (2013.01)

(58) Field of Classification Search
CPC ..... A61B 19/00; B01L 3/5082
USPC ..... 422/558
See application file for complete search history.

(56) References Cited

U.S. PATENT DOCUMENTS 4,515,752 A * 5/1985 Miramanda ..... B01L 3/50825 215/307
5,785,925 A * 7/1998 U'Ren ..... B01L 3/5021 422/550
6,030,582 A * 2/2000 Levy ..... B01L 3/50825 215/247
6,340,359 B1 * 1/2002 Silverman ..... B65D 51/002 604/415
6,893,612 B2 * 5/2005 Kacian ..... B01L 3/50825 215/247
2001/0008614 A1 * 7/2001 Aronowitz ..... A61B 10/0051 422/400
2013/0153577 A1 * 6/2013 Su ..... B32B 7/12 220/367.1
2015/0086441 A1 * 3/2015 She ..... A61L 2/18 422/294

(Continued)

OTHER PUBLICATIONS

Foam Inserts for Lacons Plastic Containers. http://www.lacontainerstore.com/Foam-Inserts_c_44.html. Published May 31, 2008.*

*Primary Examiner* — Jill Warden
*Assistant Examiner* — Jacqueline Brazin
(74) *Attorney, Agent, or Firm* — Woods Oviatt Gilman LLP; Katherine H. McGuire, Esq.

(57) ABSTRACT

A container for storing a histological sample comprises a container housing having an open top end and a bottom end defining a container interior. The container interior is configured to hold a fluid and receive the sample. A removable lid encloses the open top end. A container insert engages the container housing so as to substantially inhibit leaking of the fluid from the container. The insert includes an aperture configured to permit a sample holder containing the sample passage therethrough so as to enable depositing of the sample within the fluid in the container.

18 Claims, 2 Drawing Sheets

(56) References Cited

U.S. PATENT DOCUMENTS

2016/0157837 A1* 6/2016 Visinoni ..... A61B 10/0096
435/40.5

* cited by examiner

MEDICAL SPECIMEN CONTAINER

CROSS-REFERENCE TO RELATED APPLICATIONS

This application claims the benefit of U.S. Patent Application No. 62/024,196 filed on Jul. 14, 2014.

FIELD OF THE INVENTION

The present invention relates to specimen containers for holding specimens in preparation for biopsy, and more particularly relates to a specimen container having an insert through which a medical instrument holding a specimen may be passed to deposit the specimen in the container. The insert is self-sealing such that liquid in the container (e.g., a fixative agent such as formaldehyde) does not spill out of the container either prior to or after withdrawal of the medical instrument.

BACKGROUND

Ideally, medical sample collection should be conducted so that any collected specimens are preserved as quickly as possible. Thus, in hospital, clinical or nursing home environments, sample collection is optimally conducted at a patient's bedside wherein a collected histological specimen is immediately placed within a sample container filled with a fixative agent. However, fixative agents are generally caustic or toxic chemicals and care should be taken to avoid unwanted contact. Furthermore, many fixative agents include volatile chemicals which may irritate the eyes, nose and/or throat upon exposure.

Currently, medical specimen containers may be either filled with fixative agent fluids immediately prior to use or may come pre-charged with a fixative solution. In either case, loading of the histological specimen requires a nurse or other medical technician to open the sample container to allow deposition of the tissue sample within the fluid in the container. Upon opening of the container, volatile gases within the headspace of the container may be released into the room, possibly into the face of the nurse, technician, physician and/or patient. Further, depositing the sample within the container may lead to splashing of the fixative fluid thereby increasing the chance of unwanted exposure to the hazardous fluid. An additional hazard arises should the container lid be improperly sealed to the sample container. An improperly sealed lid may lead to leaking of the fluid, and beyond the potential contact with the fixative fluid, may lead to contact with any potentially bio-hazardous material collected and stored within the container.

Thus, there is a need for a sample container which collects and stores histological samples, particularly when the container is pre-charged with a fixative fluid wherein exposure to the fixative fluid and its vapor is minimized. The present invention addresses these and other needs.

BRIEF SUMMARY

In general, an embodiment of the present invention is directed to a container for storing a histological sample. The container comprises a container housing having an open top end and a bottom end defining a container interior. The container interior is configured to hold a fluid and receive the sample. A removable lid encloses the open top end. A container insert engages the container housing so as to substantially inhibit leaking of the fluid from the container.

The insert includes an aperture configured to permit a sample holder containing the sample passage therethrough so as to enable depositing of the sample within the fluid in the container.

In accordance with a further embodiment of the present invention, the container insert is further configured to include a resealable septum layer bonded to the top face of the container insert. The container is configured to hold a water layer between the resealable septum layer and the open top end of the container.

Additional objects, advantages and novel features of the present invention will be set forth in part in the description which follows, and will in part become apparent to those in the practice of the invention, when considered with the attached figures.

BRIEF DESCRIPTION OF THE DRAWINGS

The accompanying drawings form a part of this specification and are to be read in conjunction therewith, wherein like reference numerals are employed to indicate like parts in the various views, and wherein.

DETAILED DESCRIPTION

Figure 1:
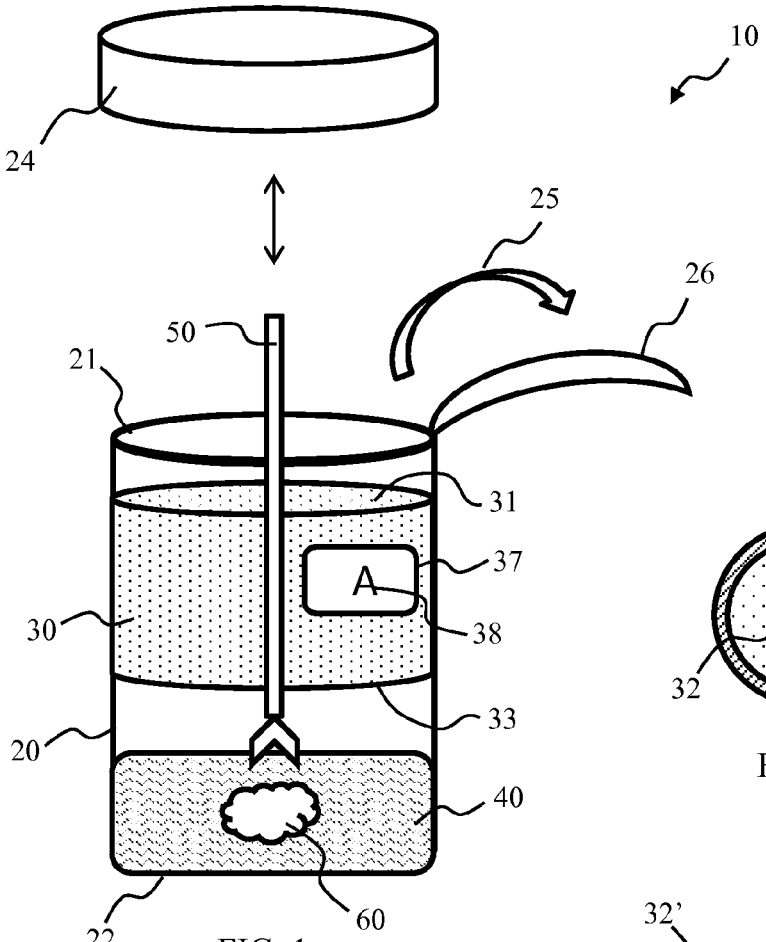
FIG. 1 is a perspective view of a specimen container in accordance with an embodiment of the invention.

With reference to FIG. 1, an embodiment of a medical specimen container in accordance with the present invention is generally indicated by reference numeral 10. As can be seen in FIG. 1, container 10 includes a container housing 20 having an open top end 21 and a bottom end 22 defining a container interior. Container 10 is configured to hold a fluid 40, such as a fixative solution comprising formalin, formaldehyde, glutar aldehyde, Bouin's fixative, ethyl alcohol or the like as is commonly practiced in the art. A lid 24 is removably secured to housing 20 so as to enclose open top end 21. In accordance with an embodiment of the present invention, lid 24 is threadably matable with housing 20. Open top end 21 may further be sealed via a seal layer 26. Seal layer 26 may be comprised of any suitable seal material commonly used within container sealing applications, including polymeric materials, foil, or laminated combinations thereof. Seal layer 26 may be configured to be a puncturable layer or may be peelably removable as indicated generally by arrow 25 so as to selectively enable access to the container interior. In accordance with an aspect of the present invention, lid 24 and/or seal layer 26 may maintain the container interior in a sterile state until the container is opened to deposit a biological sample 60.

Figure 2:
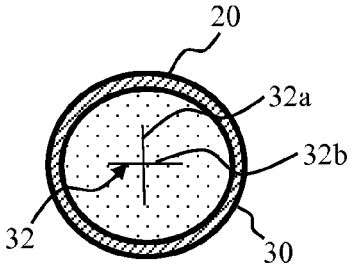
FIG. 2 is a plan view of the container insert seen in FIG. 1.

With continued reference to FIG. 1 and with attention further directed to FIG. 2, container housing 20 is adapted to carry a container insert 30. In accordance with an embodiment of the present invention, insert 30 is proportioned so as to fit snuggly within container housing 20. In one possible embodiment, insert 30 is constrained within housing 20 through a friction fit. In an alternative embodiment, insert 30 may further include a fastening engagement such as an adhesive between the outer surface of the insert 30 and the inner wall of the housing 20. In accordance with an aspect of the present invention, container insert 30 is supported by housing 20 so as to be located above the level of fluid 40 while substantially inhibiting leaking of fluid 40 from the container. As used herein, the phrase "substantially inhibiting" is to be interpreted to mean that, at most, only a minimal amount of fluid 40 bypasses insert 30 should the container be vigorously jostled or inverted. Alternatively, the level of fluid 40 may coincide with the bottom surface 33 of insert 30. In no event should fluid 40 fill the container so as to have a fluid level above the top surface 31 of insert 30. Insert 30 may be constructed of any suitable resilient yet compressible material such as, but not limited to an open- or closed-pore foam of polyethylene, polyurethane, polystyrene, silicone, nylon and combinations thereof.

Container housing 20 may further include a label portion 37 onto which may be written, affixed or displayed indicia 38. Indicia 38 may include any desired information, such as patient name, birth date, date of procedure, location of procedure, sample number or the like. In accordance with an aspect of the present invention, label portion 37 is located on the outer surface of container housing 20 above bottom surface 33 of insert 30. In this manner, neither label portion 37 nor indicia 38 overlap or otherwise obscure the portion of container 10 containing fluid 40 and, when deposited, sample 60. In this manner, medical personnel can visually inspect container 10 prior to deposition of a sample to ensure that the container has not been previously used.

As can best be seen in FIG. 2, insert 30 is configured to define an aperture 32 through which a sample holder 50 containing a sample 60 may be passed. By way of example, sample holder 50 may be biopsy forceps used to extract a tissue sample from a patient. As shown in FIG. 2, aperture 32 is formed by at least one slit extending the longitudinal length of insert 30 (i.e. from a top face 31 to bottom face 33 as shown in FIG. 1). Opposing faces of the slit and arranged to be held within touching contact with one another so as to create a friction seal and thereby inhibit or prevent unwanted passage of fluid 40 through the aperture 32. In accordance with an aspect of the present invention, aperture 32 is formed by two slits, with first slit 32*a* being generally perpendicular to second slit 32*b*. In this manner, sample holder 50 may penetrate insert 30 by displacing and compressing the foam material of the insert. Passage of sample holder 50 through the body of insert 30 allows deposition of sample 60 within fluid 40 within container housing 20 (see FIG. 1). In accordance with an aspect of the present invention, insert 30 may compress so as to snuggly envelop sample holder 50 as the sample holder resides within the insert. In this manner unwanted escape of fluid 40 from the container may be minimized or prevented while sample 60 is being deposited. Upon withdrawal of sample holder 50, insert 30 decompresses and reseals aperture 32 to, once again, substantially inhibit leakage of fluid 40 from container 10.

Figure 3:
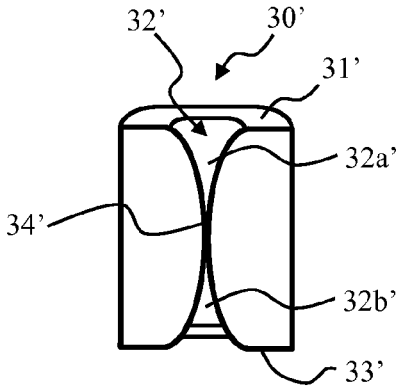
FIG. 3 is a perspective view of an embodiment of the container insert.

Turning now to FIG. 3, an alternative embodiment of a container insert 30' is configured to include an aperture 32' comprised of a pair of indentations 32*a*'/32*b*' depending, respectively, from opposing top face 31' and bottom face 33' of insert 30'. In accordance with a further embodiment of the present invention, aperture 32' may include a single indentation depending from either the top face or bottom face. As seen in FIG. 3, there remains at least some sealable portion 34' of aperture 32' so as to prevent passage of fluid 40 through the aperture 32'. Indentations 32*a*'/32*b*' are configured to reduce friction between sample holder 50 and insert 30' by reducing the amount of insert 30' engaged by sample holder 50 when the sample holder is slidably inserted into and withdrawn from container 10. However, sealable portion 34' is proportioned to maintain a sufficient seal so as to substantially inhibit leaking of the fluid 40 from container housing 20 before, during and after the deposition of sample 60.

Figure 4:
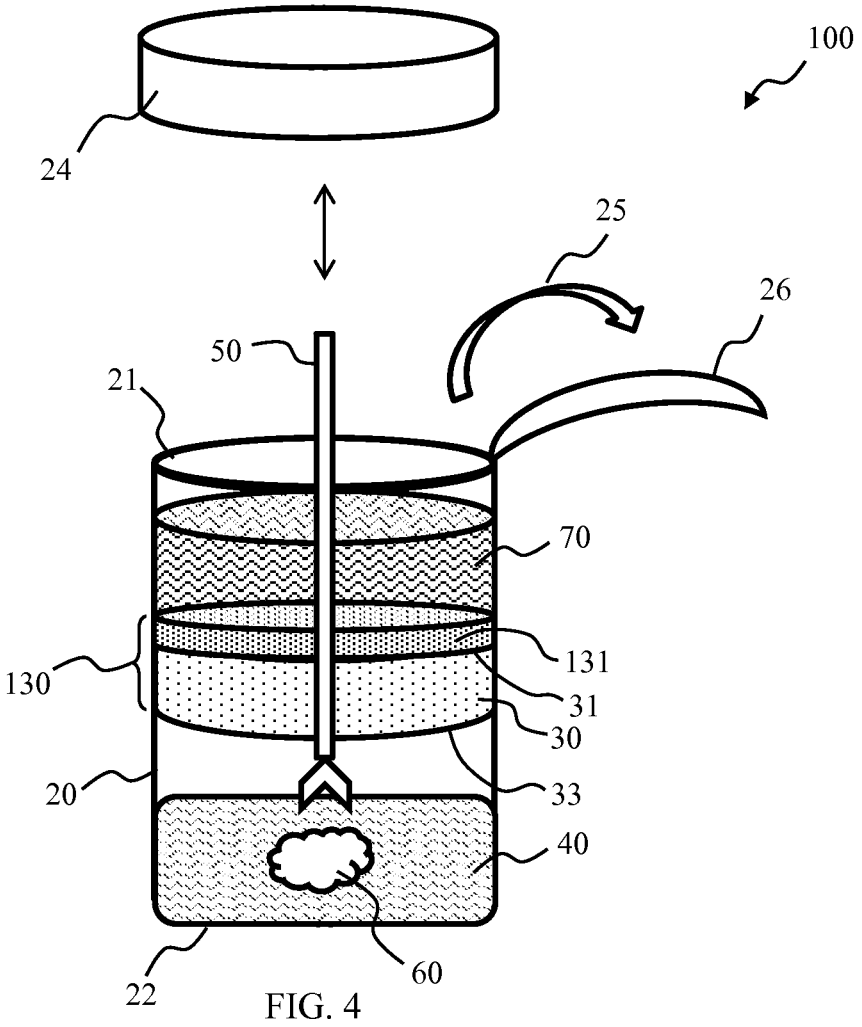
FIG. 4 is a perspective view of a specimen container in accordance with a further embodiment of the invention.

Turning now to FIG. 4, an alternative embodiment of a medical specimen container n accordance with the present invention is generally indicated by reference numeral 100. Medical specimen container 100 is similar to medical specimen container 10 of FIG. 1 except for the provision of a water layer 70 situated above the container insert (such as container insert 130 which will be discussed in more detail below). Water layer 70 allows sample holder 50 to be rinsed following passage through insert 30/130 and deposition of sample 60 within fluid 40. In this manner, any hazardous fluid, such as a fixative solution comprising fluid 40, is removed from sample holder 50 before the sample holder is extracted from container 100. This rinsing reduces the potential for inadvertent contact with the fixative solution. Water layer 70 also serves to create a gas barrier between fluid 40 and top end 21 of container 100. As a result of this gas barrier, any volatilization of fluid 40 is isolated to the headspace located between the top of fluid 40 and the bottom of container insert 30/130 such that a nurse, technician, physician and/or patient does not come into contact with or otherwise inhale potentially harmful fluid 40 fumes upon opening of container 100.

In accordance with an aspect of embodiment 100 of the present invention, the comingling of water 70 and fluid 40 is minimized, and in a further aspect, is prevented such as by way of container insert 130. Container insert 130 is similar to container insert 30 describe above with regard to embodiment 10 but has been adapted to include a resealable septum layer 131 bonded to top surface 31 of container insert 30. Resealable septum layer 131 is configured to provide a watertight barrier between water 70 and fluid 40 while also being puncturable to permit selective insertion and withdrawal of sample holder 50. Resealable septum layer 131 may be further configured to sealingly engage sample holder 50 while the sample holder penetrates the septum material. In this manner, the watertight barrier is maintained while sample 60 is being deposited. Resealable septum layer 131 is still further configured to reseal upon withdrawal of sample holder 50 from septum layer following deposition of sample 60 within fluid 40.

In accordance with an aspect of the present invention, resealable septum layer 131 may be comprised of any suitable material, such as but not limited to natural and synthetic rubber, silicone, thermoplastic elastomers and combinations thereof. Resealable septum layer 131 may have any suitable thickness so long as the material thickness provides the requisite sealing, puncturability and resealability properties as described above.

In accordance with an aspect of the present invention, insert 30/30', including that portion 30 of insert 130, may be impregnated with an anti-microbial agent so as to assist in maintaining a sterile field within container housing 20. Alternatively and/or additionally, insert 30/30' and its respective aperture 32/32' may be surface coated with an anti-microbial agent.

Although the present invention has been described in considerable detail with reference to certain aspects thereof, other versions are possible. Therefore, the spirit and scope of the appended claims should not be limited to the description of the aspects contained herein.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A container for storing a histological sample comprising:

a container housing having an open top end and a bottom end defining a container interior configured to hold a fluid and receive the sample therein;

a removable lid for enclosing the open top end; and a container insert defined by a top face, bottom face and continuous sidewall, the container insert fixedly secured within the container housing a spaced distance below the top end and a spaced distance above the bottom end of the container interior through an adhesive between the sidewall of the insert and an interior surface of the container housing whereby the container insert is configured to remain engaged with the container housing upon removal of the removable lid, the container insert including a resealable aperture configured to permit a biopsy forceps containing the sample passage therethrough, wherein the container insert substantially inhibits leaking of the fluid from the container.

2. The container according to claim 1 wherein the aperture is self-sealing.

3. The container according to claim 1 wherein the insert is constructed of a resilient yet compressible material.

4. The container according to claim 3 wherein the resilient yet compressible material is selected from the group consisting of polyethylene, polyurethane, polystyrene, silicone, nylon and combinations thereof.

5. The container according to claim 1 wherein the container housing includes a label portion located on an exterior surface of the container housing above the bottom face of the container insert.

6. The container according to claim 1 wherein the resealable aperture is formed by one or more slits extending from the top face to the bottom face of the insert.

7. The container according to claim 1 wherein the resealable aperture includes a first indentation depending from either the top face or the bottom face.

8. The container according to claim 7 wherein the resealable aperture includes a second indentation depending from the other of the top face or the bottom face, a sealable portion being located between the first and second indentations.

9. The container according to claim 1 wherein the container further comprises a preloaded fluid within the container interior.

10. The container according to claim 1 wherein the insert includes an anti-microbial agent impregnated therein.

11. The container according to claim 1 wherein the insert and the aperture further include a surface coating comprising an anti-microbial agent.

12. The container according to claim 1 further including a seal layer covering the open top end.

13. The container according to claim 12 wherein the seal layer is peelable from the container.

14. The container according to claim 12 wherein the seal layer is puncturable by the biopsy forceps.

15. A container for storing a histological sample comprising:

a container housing having an open top end and a bottom end defining a container interior configured to hold a fluid and receive the sample therein;

a removable lid for enclosing the open top end; and a container insert defined by a top face, bottom face and continuous sidewall, the container insert fixedly secured within the container housing above a fluid level of the fluid, the container insert including a resealable aperture configured to permit a sample holder containing the sample passage therethrough, the container insert further configured to include a resealable liquid-impermeable septum layer bonded to the top face of the container insert, wherein the container insert substantially inhibits leaking of the fluid from the container.

16. The container according to claim 15 wherein the container is further configured to hold a water layer between the resealable septum layer and the removable lid of the container.

17. The container according to claim 15 wherein the resealable septum layer is comprised of a natural rubber, a synthetic rubber, silicone, one or more thermoplastic elastomers and combinations thereof.

18. A container for storing a histological sample comprising:

a container housing having an open top end and a bottom end defining a container interior configured to hold a fluid and receive the sample therein;

a removable lid for enclosing the open top end; and a container insert defined by a top face, bottom face and continuous sidewall, the container insert fixedly secured within the container housing a spaced distance below the top end and a spaced distance above the bottom end of the container interior through an adhesive between the sidewall of the insert and an interior surface of the container housing whereby the container insert is configured to remain engaged with the container housing upon removal of the removable lid, the container insert including an anti-microbial agent and a resealable aperture configured to permit a sample holder containing the sample passage therethrough, wherein the container insert substantially inhibits leaking of the fluid from the container.

* * * * *